US006273809B1

(12) United States Patent
Bell et al.

(10) Patent No.: US 6,273,809 B1
(45) Date of Patent: Aug. 14, 2001

(54) COIN DISPENSING APPARATUS

(75) Inventors: Mike Bell, Leeds; Colin Richard Spooner, Wymondham; Brian John Spooner, Surlingham, all of (GB)

(73) Assignee: Coin Controls Limited, Lancashire (GB)

( * ) Notice: Subject to any disclaimer, the term of this patent is extended or adjusted under 35 U.S.C. 154(b) by 0 days.

(21) Appl. No.: 09/147,455

(22) PCT Filed: Jun. 13, 1997

(86) PCT No.: PCT/GB97/01604

§ 371 Date: Mar. 17, 1999

§ 102(e) Date: Mar. 17, 1999

(87) PCT Pub. No.: WO98/00816

PCT Pub. Date: Jan. 8, 1998

(30) Foreign Application Priority Data

Jun. 29, 1996 (GB) ..... 9613702

(51) Int. Cl.[7] ..... G07D 1/00
(52) U.S. Cl. ..... 453/57
(58) Field of Search ..... 453/40, 49, 57

(56) References Cited

U.S. PATENT DOCUMENTS

| | | | | |
|---|---|---|---|---|
| 693,047 | * | 2/1902 | Miller | 453/49 |
| 3,680,566 | | 8/1972 | Tanaka et al. . | |
| 4,392,505 | * | 7/1983 | Maloney et al. | 453/40 |
| 4,413,750 | * | 11/1983 | Marrone et al. | 453/49 X |
| 5,064,404 | * | 11/1991 | Champion | 453/57 X |
| 5,098,339 | | 3/1992 | Dabrowski | 453/30 |
| 5,316,517 | | 5/1994 | Chiba et al. | 453/57 |

FOREIGN PATENT DOCUMENTS

| | | | | |
|---|---|---|---|---|
| 0 211 512 | | 2/1987 | (EP) . | |
| 0266021 | * | 5/1988 | (EP) | 453/57 |
| 2 401 469 | | 3/1979 | (FR) . | |

* cited by examiner

*Primary Examiner*—F. J. Bartuska
(74) *Attorney, Agent, or Firm*—Arent Fox Kintner Plotkin & Kahn, PLLC

(57) ABSTRACT

Coin dispensing apparatus is provided including a reservoir for coins and a rotor located to receive coins from the reservoir, the rotor having a lower storage portion shaped to receive a stack of coins, and an upper feed portion shaped to receive coins from the reservoir and direct them to the lower storage portion. Because the rotor receives and feeds the coins, to provide a stack of coins within the lower storage portion, ready for dispensing, the associated reservoir can be of a size to receive any type of coin. If it is necessary to adapt the apparatus to accept a different type of coin, it is only necessary to replace the rotor.

17 Claims, 1 Drawing Sheet

COIN DISPENSING APPARATUS

Figure 1:
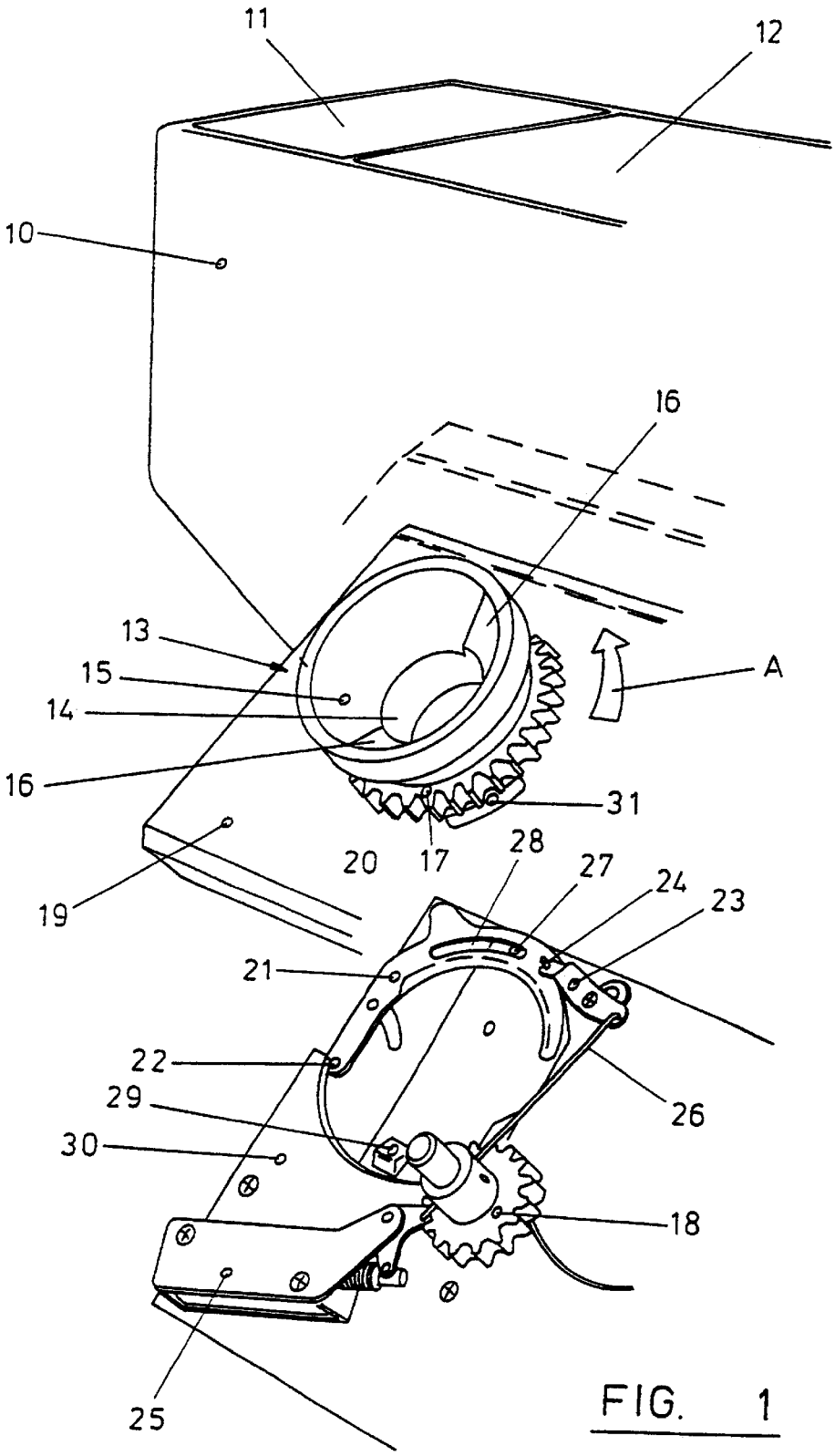

The invention relates to coin dispensing apparatus and particularly, but not exclusively, to coin dispensing apparatus for use in vending machines.

In this specification the term coin will be used to include not only monetary units but also similar shaped items such as tokens.

Many vending machines receive coins for the payment of the items being vended from the machines, but must also be able to sort and dispense coins to provide change.

In known coin dispensing apparatus for use with vending machines, coins of different value are stacked in tubes, each tube being specific to one type of coin, so that when it is desired to dispense a coin having a particular value, the coin can simply be released from the bottom of the relevant stack of coins.

Dispensing of the coins from the bottom of the stacks is relatively straight forward, but there are difficulties in ensuring that the coins are accurately sorted and fed into the tops of the tubes and furthermore, if it becomes necessary to alter the coins with which a particular machine can deal, for example because of a change in pricing structure, then the entire coin dispensing unit, including all the tubes, has to be replaced.

We have now developed a more versatile and more readily adaptable coin dispensing apparatus which is particularly suitable for use in the limited space which is available in vending machines.

The invention provides coin dispensing apparatus comprising a reservoir for coins, and a rotor located to receive coins from the reservoir, the rotor having a lower storage portion shaped to receive a stack of coins, and an upper feed portion shaped to receive coins from the reservoir and direct them to the lower storage portion.

Because the rotor receives and feeds the coins to provide a stack of coins within the lower storage portion, ready for dispensing, the associated reservoir can be of a size to receive any type of coin. If it is necessary to adapt the apparatus to accept a different type of coin, it is only necessary to replace the rotor.

In practice there will normally be a plurality of rotors, each adapted to deal with a different type of coin, each rotor being associated with its own reservoir.

The reservoirs associated with the plurality of rotors may comprise a coin hopper with a plurality of internal walls dividing it into separate compartments.

Preferably each rotor is mounted in the lower part of a hopper.

The lower storage portion of the, or each, rotor may comprise a relatively short tubular portion having a diameter slightly larger than a coin with which the rotor is associated.

The upper feed portion of the, or each rotor, may comprise a frusto-conical portion.

Preferably the upper feed portion of the, or each, rotor has at least one projection thereon, to engage with coins within the reservoir and cause coins to move around with the rotor, increasing the tendency for the coins to slide down within the upper feed portion until they drop into the lower storage portion.

The upper feed portion may have two projecting ribs, arranged on opposite sides of the lower storage portion.

The lower storage portion of the, or each, rotor may be spaced from a lower bed member by a distance which is greater than the thickness of the coin, dispensing of a coin from the bottom of a stack being carried out by movement of a dispensing member movable between the rotor and the bed.

The dispensing member may be biased into a dispensing position, the dispensing member normally being held in a non dispensing position, against the action of the bias, by means of a catch.

There may be means operable to release the catch when it is desired to dispense a coin.

The means operable to release the catch may comprise a solenoid.

Means may be provided to reset the coin dispensing member into its non dispensing position, after a coin has been dispensed.

The means to reset the coin dispensing member may comprise a projection on a rotor.

The projection on the rotor may comprise a cam member.

The coin dispensing member may comprise a pivotally mounted lever.

The lever may have an arcuate portion to engage around the coin being dispensed.

The dispensing member, for example in the form of the lever having an arcuate portion, may also be used to dispense coins from conventional apparatus without necessarily using the novel rotor according to the invention.

By way of example a specific embodiment of the invention will now be described, with reference to the accompanying drawing, in which FIG. 1 comprises, an exploded perspective view of one embodiment of coin dispensing apparatus according to the invention.

The apparatus comprises a coin hopper 10 divided up into a plurality of different compartments such as 11, 12 each compartment serving as a reservoir for one particular dimension of coin received from validation apparatus of a vending machine within which the dispensing apparatus will be mounted during use. At the lower end of each compartment there is mounted a rotor for the handling and dispensing of the type of coin with which that compartment is associated. Although the rotors differ in dimensions, as will be described later, their mode of operation is identical, and so only one rotor 13 and its associated components will be described in detail.

The rotor 13 has a lower storage portion 14 which comprises a cylindrical tube to receive a short stack of coins. The rotor also has an upper feed portion 15 which is frusto-conical in shape and has two, diametrically opposed, projecting ribs 16.

The rotor has a drive gear 17 on the outer periphery thereof and when the apparatus is assembled this drive gear engages with a pinion 18 which is driven by a motor (not shown) via a gear box (not shown).

The rotor is shrouded by a housing 19 and is located at the lower end of the compartment 11 such that as the rotor rotates, in the direction of arrow A, the projecting ribs 16 engage with coins and stir them around such that they gradually slide down within the frusto-conical portion 15 and drop into the tubular portion 14, somewhat in the manner of water disappearing down a plug hole.

Below the tubular portion 14 the lowermost coin lies against a bed in the form of a slidable plate 20. Mounted between the plate 20 and the rotor is a coin dispensing lever 21 which is pivotally mounted at 22.

During feeding and storage of the coins, the lever 21 is held in an inoperative position by a catch 23 which engages with a stop 24 on the lever 21.

The catch 23 is connected to a solenoid 25 by a link 26.

When it is desired to eject a coin, the solenoid 25 is actuated to pivot the catch 23 clear of the stop 24. The lever 21 then pivots downwardly under the action of a spring (not shown) sliding the lowermost coin away from underneath the stack of coins contained within the tubular portion 14.

The bed 20 also moves downwardly with the coin, this movement being brought about by means of a pin 27 on the bed which engages with an arcuate slot 28 in the lever 21.

Mounted on the bed 20 is a coin release toggle 29. As the coin to be dispensed is moved downwardly by means of the lever 21, the coin eventually reaches a position in which it can slide clear of the toggle 29 and drop into a coin chute leading to an outlet from the machine. The coin chute is not visible in the FIGURE being obscured by a cover 30 for the coin chute.

After a coin has been dispensed, the lever 21 is returned to the position shown in the FIGURE, against the action of the spring, by engagement of a cam member 31 on the rotor 13. The cam member 31 is caused to engage with the stop 24 on the lever 21 by continued rotation of the rotor.

Should changes in the products handled by the vending machine, changes in pricing structure, or other changes such as issuance of new coinage, mean that one or more of the compartments 11, 12 etc have to handle a different coin, the only modification needed to the machine is to remove the rotor 13 and replace it with another rotor of different dimensions.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. Coin dispensing apparatus comprising a plurality of upwardly extending coin reservoirs, arranged side by side, each reservoir being associated with a rotor located to receive coins from the associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus in which the upper feed portion of the, or each, rotor comprises a frusto-conical portion.

2. Coin dispensing apparatus as claimed in claim 1, in which the rotational axis of each rotor is inclined at an angle to the vertical.

3. Coin dispensing apparatus as claimed in claim 1, in which the reservoirs associated with the plurality of rotors comprise a coin hopper with a plurality of internal walls dividing it into separate compartments.

4. Coin dispensing apparatus as claimed in claim 1, in which each rotor is mounted in the lower part of the hopper.

5. Coin dispensing apparatus as claimed in claim 1, in which the lower storage portion of the, or each, rotor comprises a relatively short tubular portion having a diameter slightly larger than a coin with whiz the rotor is associated.

6. Coin dispensing apparatus as claimed in claim 1, in which the upper feed portion of the, or each, rotor has at least one projection thereon, to engage with coins within the reservoir and cause coins to move around with the rotor, increasing the tendency for the coins to slide down within the upper feed portion until they drop into the lower storage portion.

7. Coin dispensing apparatus as claimed in claim 1, in which the lower storage portion of the, or each, rotor is spaced from the lower bed member by a distance which is greater than the thickness of the coin, the dispensing of a coin from the bottom of the stack being carried out by movement of a dispensing member movable between the rotor and the bed.

8. Coin dispensing apparatus as claimed in claim 7, having means to reset the coin dispensing member into its non dispensing position, after a coin has been dispensed.

9. Coin dispensing apparatus comprising a plurality of upwardly extending coin reservoirs, arranged side by side, each reservoir being associated with a rotor located to receive coins from the associated reservoir, each rotor having a lower coin storage portion, and an upper feed portion which is rotatable with the lower coin storage portion and is shaped to receive coins from the associated reservoir and direct them to the lower storage portion, the provision of the plurality of side by side reservoirs enabling a plurality of different types of coin to be handled with a single apparatus;

in which the upper feed portion of the, or each, rotor has at least one projection thereon, to engage with coins within the reservoir and cause coins to move around with the rotor, increasing the tendency for the coins to slide down within the upper feed portion until they drop into the lower storage portion; and in which the upper feed portion has two projecting ribs, arranged on opposite sides of the lower storage portion.

10. Coin dispensing apparatus comprising a plurality of upwardly extending coin reservoirs, arranged side by side, each reservoir being associated with a rotor located to receive coins from the associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus;

in which the lower storage portion of the, or each, rotor is spaced from the lower bed member by a distance which is greater than the thickness of the coin, the dispensing of a coin from the bottom of the stack being carried out by movement of a dispensing member movable between the rotor and the bed; and in which the dispensing member is biased into a dispensing portion, the dispensing member normally being held in a non dispensing position, against the action of the bias, by means of a catch.

11. Coin dispensing apparatus as claimed in claim 10, in which there is means operable to release the catch when it is desired to dispense a coin.

12. Coin dispensing apparatus as claimed in claim 11, in which the means operable to release the catch comprises a solenoid.

13. Coin dispensing apparatus comprising a plurality of upwardly extending coin reservoirs, arranged side by side, each reservoir being associated with a rotor located to receive coins from the associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus in which the lower storage portion of the, or each, rotor is spaced from the lower bed member by a distance which is greater than the thickness of the coin, the dispensing of a coin from the bottom of the stack being carried out by movement of a dispensing member movable between the rotor and the bed; and having means to reset the coin dispensing member into its non dispensing position, after a coin has been dispensed; and in which the means to reset the coin dispensing member comprises a projection on a rotor.

14. Coin dispensing apparatus as claimed in claim 13, in which the projection on the rotor comprises a cam member.

15. Coin dispensing apparatus comprising a plurality of upwardly extending coin reservoirs, arranged side by side, each reservoir being associated with a rotor located to receive coins from the associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus in which the lower storage portion of the, or each, rotor is spaced from the lower bed member by a distance which is greater than the thickness of the coin, the dispensing of a coin from the bottom of the stack being carried out by movement of a dispensing member movable between the rotor and the bed; and in which the coin dispensing member comprises a pivotally mounted lever.

16. Coin dispensing apparatus as claimed in claim 15, in which the lever has an arcuate portion to engage around the coin being dispensed.

17. Coin dispensing apparatus comprising a plurality of upwardly extending coin reservoirs, arranged side by side, each reservoir being associated with a rotor located to receive coins from the associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus in which the lower storage portion of the, or each, rotor is spaced from the lower bed member by a distance which is greater than the thickness of the coin, the dispensing of a coin from the bottom of the stack being carried out by movement of a dispensing member movable between the rotor and the bed; and in which the dispensing member comprises a pivotally mounted lever, the lever having an arcuate portion to engage around the coin being dispensed.

* * * * *

US006273809C1

(12) EX PARTE REEXAMINATION CERTIFICATE (6204th)

United States Patent

Bell et al.

(10) Number: US 6,273,809 C1

(45) Certificate Issued: Apr. 22, 2008

(54) COIN DISPENSING APPARATUS

(75) Inventors: Mike Bell, Leeds (GB); Colin Richard Spooner, Wymondham (GB); Brian John Spooner, Surlingham (GB)

(73) Assignee: Money Controls Limited, Royton, Olkham, Lancashire (GB)

Reexamination Request:
No. 90/007,050, Jun. 19, 2003

Reexamination Certificate for:

| | |
|---|---|
| Patent No.: | **6,273,809** |
| Issued: | **Aug. 14, 2001** |
| Appl. No.: | **09/147,455** |
| Filed: | **Dec. 29, 1998** |

(22) PCT Filed: Jun. 13, 1997

(86) PCT No.: PCT/GB97/01604

§ 371 (c)(1), (2), (4) Date: Mar. 17, 1999

(87) PCT Pub. No.: WO98/00816

PCT Pub. Date: Jan. 8, 1998

(30) Foreign Application Priority Data

Jun. 29, 1996 (GB) ..... 9613702

(51) Int. Cl.
*G07D 1/00* (2006.01)

(52) U.S. Cl. ..... 453/57

(58) Field of Classification Search ..... 453/40, 453/49, 57

See application file for complete search history.

(56) References Cited

U.S. PATENT DOCUMENTS

| | | | | |
|---|---|---|---|---|
| 4,441,515 A | * | 4/1984 | Goepner | 453/32 |
| 5,064,404 A | * | 11/1991 | Champion | 453/17 |

FOREIGN PATENT DOCUMENTS

| | | | |
|---|---|---|---|
| EP | 0211512 | * | 2/1987 |
| EP | PCT/GB97/01604 | * | 6/1997 |
| GB | 1445089 | * | 8/1976 |
| JP | 3130893 | * | 6/1991 |

* cited by examiner

*Primary Examiner*—Gene O. Crawford

(57) ABSTRACT

Coin dispensing apparatus is provided including a reservoir for coins and a rotor located to receive coins from the reservoir, the rotor having a lower storage portion shaped to receive a stack of coins, and an upper feed portion shaped to receive coins from the reservoir and direct them to the lower storage portion. Because the rotor receives and feeds the coins, to provide a stack of coins within the lower storage portion, ready for dispensing, the associated reservoir can be of a size to receive any type of coin. If it is necessary to adapt the apparatus to accept a different type of coin, it is only necessary to replace the rotor.

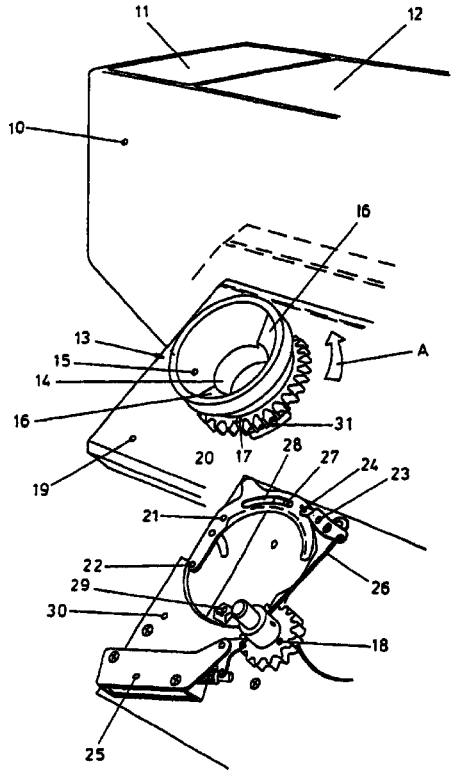

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 5, 7, 9, 10, 13, 15 and 17 are determined to be patentable as amended.

Claims 3, 4, 6, 8, 11, 12, 14 and 16, dependent on an amended claim, are determined to be patentable.

1. Coin dispensing apparatus comprising a plurality of upwardly extending coin reservoirs, arranged side by side, each reservoir being associated with a *single* rotor, *rotatable about an axis of a single central opening in the rotor and* located to receive coins from the associated reservoir, each rotor having a lower coin storage portion, and an upper feed portion, *frusto-conically* shaped, *about the entire circumference of the opening,* to receive coins from the associated reservoir and direct the coins to the lower storage portion, the provision of the plurality of side by side reservoirs enabling a plurality of different types of coins to be handled with a single apparatus in which the upper feed portion of the, or each, rotor comprises a frusto-conical portion.

2. Coin dispensing apparatus [as claimed in claim 1] *comprising a plurality of upwardly extending coin reservoirs, arranged side by side, each reservoir being associated with a single rotor, rotatable about an axis of a single central opening in the rotor and located to receive coins from the associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus in which the upper feed portion of the, or each, rotor comprises a frusto-conical portion*, in which the rotational axis of each rotor is inclined at an angle to the vertical.

5. Coin dispensing apparatus as claimed in claim 1, in which the lower storage portion of the, or each, rotor comprises a relatively short tubular portion having a diameter slightly larger than a coin with [whiz] *which* the rotor is associated.

7. Coin dispensing apparatus [as claimed in claim 1] *comprising a plurality of upwardly extending coin reservoirs, arranged side by side, each reservoir being associated with a single rotor, rotatable about an axis of a single central opening in the rotor and located to receive coins from the associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus in which the upper feed portion of the, or each rotor comprises a frusto-conical portion*, in which the lower storage portion of the, or each, rotor is spaced from the lower bed member by a distance which is greater than the thickness of the coin, the dispensing of a coin from the bottom of the stack being carried out by the movement of a dispensing member movable between the rotor and the bed.

9. Coin dispensing apparatus comprising a plurality of upwardly extending coin reservoirs, arranged side by side, each reservoir being associated with a *single* rotor, *rotatable about the axis of a single central opening in the rotor and* located to receive coins from the associated reservoir, each rotor having a lower coin storage portion, and an upper feed portion which is rotatable with the lower coin storage portion and is *frusto-conically* shaped, *about the entire circumference of the opening* to receive coins from the associated reservoir and direct them to the lower storage portion, the provision of the plurality of side by side reservoirs enabling a plurality of different types of coin to be handled with a single apparatus;

in which the upper feed portion of the, or each, rotor has at least one projection thereon, to engage with coins within the reservoir and cause coins to move around with the rotor, increasing the tendency for the coins to slide down within the upper feed portion until they drop into the lower storage portion; and in which the upper feed portion has two projecting ribs, arranged on opposite sides of the lower storage portion.

10. Coin dispensing apparatus comprisng a plurality of upwardly extending coin reservoirs, arranged side by side, each reservoir being associated with a *single* rotor, *rotatable about the axis of a single central opening in the rotor and* located to receive coins from the associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus;

in which the lower storage portion of the, or each, rotor is spaced from the lower bed member by a distance which is greater than the thickness of the coin, the dispensing of a coin from the bottom of the stack being carried out by movement of a dispensing member movable between the rotor and the bed; and in which the dispensing member is biased into a dispensing portion, the dispensing member normally being held in a non dispensing position, against the action of the bias, by means of a catch.

13. Coin dispensing apparatus comprising a plurality of upwardly extending coin reservoirs, arranged side by side, each reservoir being associated with a *single* rotor, *rotatable about the axis of a single central opening in the rotor and* located to receive coins from an associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus in which the lower storage portion of the, or each, rotor is spaced from the lower bed member by a distance which is greater than the thickness of the coin, the dispensing of a coin from the bottom of the stack being carried out by movement of a dispensing member movable between the rotor and the bed; and having means to reset the coin dispensing member into its non dispensing position, after a coin has been dispensed; and in which the means to reset the coin dispensing member comprises a projection on a rotor.

15. Coin dispensing apparatus comprising a plurality of upwardly extending coin reservoirs, arranged side by side, each reservoir being associated with a *single* rotor, *rotatable about the axis of a single central opening in the rotor and* located to receive coins from the associated reservoir, each rotor having a lower coin storage portion, and an upper feed portion *frusto-conically* shaped, *about the entire circumference of the opening,* to receive coins from the associated reservoir and direct the coins to the lower storage portion, the provision of the plurality of side by side reservoirs enabling a plurality of different types of coins to be handled with a single apparatus in which the lower storage portion of the, or each, rotor is spaced from the lower bed member by a distance which is greater than the thickness of the coin, the dispensing of a coin from the bottom of the stack being carried out by movement of a dispensing member movable between the rotor and the bed; and in which the coin dispensing member comprises a pivotally mounted lever.

17. Coin dispensing apparatus comprising a plurality of upwardly extending coin reservoirs, arranged side by side, each reservoir being associated with a *single* rotor, *rotatable about the axis of a single central opening in the rotor and* located to receive coins from the associated reservoir, each rotor having a lower coin storage portion, and an upper feed portion shaped to receive coins from the associated reservoir and direct the coins to the lower storage portion, the provision of the plurality of side by side reservoirs enabling a plurality of different types of coins to be handled with a single apparatus in which the lower storage portion of the, or each, rotor is spaced from the lower bed member by a distance which is greater than the thickness of the coin, the dispensing of a coin from the bottom of the stack being carried out by movement of a dispensing member movable between the rotor and the bed; and in which the dispensing member comprises a pivotally mounted lever, the lever having an arcuate portion to engage around the coin being dispensed.

* * * * *